US005482203A

United States Patent [19]

Stout

[11] Patent Number: 5,482,203

[45] Date of Patent: Jan. 9, 1996

[54] HANDLE REINFORCEMENT FOR A CARTON

[75] Inventor: James T. Stout, Ellijay, Ga.

[73] Assignee: The Mead Corporation, Dayton, Ohio

[21] Appl. No.: 281,549

[22] Filed: Jul. 28, 1994

Related U.S. Application Data

[63] Continuation of Ser. No. 116,307, Sep. 3, 1993, abandoned.

[51] Int. Cl.[6] ..... B65D 5/46

[52] U.S. Cl. ..... 229/117.13; 206/141

[58] Field of Search ..... 229/117.12, 117.13, 229/40; 206/141, 161, 162, 428

[56] References Cited

U.S. PATENT DOCUMENTS

| | | | |
|---|---|---|---|
| 3,994,432 | 11/1976 | Kirby, Jr. | 229/117.13 |
| 4,378,905 | 4/1983 | Roccaforte | 229/117.12 |
| 4,538,759 | 9/1985 | Dutcher | 206/427 X |
| 4,860,944 | 8/1989 | Wonnacott | 229/40 X |
| 5,098,015 | 3/1992 | Calvert | 229/40 X |
| 5,119,985 | 6/1992 | Dawson et al. | 229/117.13 |
| 5,221,041 | 6/1993 | Stout et al. | 206/141 X |
| 5,246,112 | 9/1993 | Stout et al. | 229/40 X |

*Primary Examiner*—Stephen J. Castellano
*Assistant Examiner*—Christopher J. McDonald
*Attorney, Agent, or Firm*—Thomas A. Boshinski

[57] ABSTRACT

A carton for containers such as cans or bottles includes a top wall, pair of side walls and a bottom wall interconnected to form a tubular structure. End closure structure includes an end flap connected to each end edge of the top wall. A handle aperture is defined in the top wall and positioned thereon generally centrally of the top wall. A handle reinforcing structure includes a pair of end portions, one of the end portions connected along a side edge of each of the end flaps and extending to the top edge thereof, and a central portion connected to each of the end portions and extending therebetween. The central portion is secured in overlapping relationship to the top wall and positioned thereon to be substantially adjacent to a portion of the handle aperture.

15 Claims, 4 Drawing Sheets

HANDLE REINFORCEMENT FOR A CARTON

This is a continuation of Ser. No. 08/116,307 filed Sep. 3, 1993 now abandoned.

BACKGROUND OF THE INVENTION

The present invention relates generally to paperboard cartons for use in packaging containers such as cans or bottles for beverages. More particularly, the invention relates to a reinforced handle for such cartons.

Containers such as cans or bottles for beverages including soft drink, beer, juices and the like are commonly sold in multiple quantities packaged in a paperboard carton. For the convenience of the consumer, the carton is often provided with a handle, which quite commonly includes as a primary feature one or two slots or other apertures formed in the carton. The user inserts the hand or fingers into one or both of the slots to lift the carton. Many varieties of handles are known in the art.

Lifting a carton containing beverage cans or bottles introduces considerable stress into the paperboard from which the carton is formed. For this reason, to prevent tearing of the paperboard and failure of the carton, it is known to design carton handles with various reinforcement structures. This is often accomplished by providing two, three or more layers of paperboard in the vicinity of the handle slots.

Recently, attempts have been made to introduce into the marketplace beverage cartons wherein cans are arranged in two tiers, with corresponding cans from each tier being axially aligned. An example of such a carton can be seen by reference to U.S. Pat. No. 5,234,102. Such cartons are intended to hold relatively large numbers of cans, for example 24 to 36 cans. The contained weight of these cartons makes use of reinforced handle structures particularly advantageous.

It is usually desirable to provide the handle reinforcing flaps or panels as part of the blank for such a carton, thereby to eliminate the need to manipulate multiple pieces in the carton loading operation. A common way to accomplish this is to provide lapped top panels at opposite ends of the carton blank. To save some paperboard, one or both of the lapped panels may comprise only a portion of the completed top panel. An example of this type of handle reinforcement may be seen in U.S. Pat. No. 5,221,041.

However, especially a large carton such as the two-tier example described above, a relatively large blank results from this approach. Thus, it is important that the addition of such reinforcing panels or flaps not significantly increase the overall size of the carton blank. This is especially true when considering the layout of blanks on the paperboard web from which the cartons are manufactured, where an increase in blank size can significantly increase the amount of paperboard required.

What is needed, therefore, is a reinforced handle structure wherein the reinforcement is accomplished using a single-piece blank. The reinforcement structure should not significantly increase the blank size. Rather, it should be relatively compact to most efficiently use layout space on the paperboard web from which the cartons are formed.

SUMMARY OF THE INVENTION

In accordance with one embodiment, the present invention provides a carton for containers such as cans or bottles including a top wall having opposed side edges and opposed end edges and a pair of side walls. One of the side walls is connected to each of the side edges of the top wall, and a bottom wall is connected between the side walls to complete a tubular structure. End closure structure closes each end of the tubular structure, the end closure structure including an end flap connected at a top edge to each of the end edges of the top wall. Each of the end flaps has a pair of side edges.

A handle aperture is defined in the top wall and positioned thereon generally centrally of the top wall. A handle reinforcing structure includes a pair of end portions, one of the end portions connected along one side edge of each of the end flaps and extending to the top edge thereof, and a central portion connected to each of the end portions and extending therebetween. The central portion is secured in overlapping relationship to the top wall and positioned thereon to be substantially adjacent to a portion of the handle aperture.

The top wall may have a pair of handle portions formed therein. The central portion is then positioned on the top wall to extend between the apertures, adjacent to a portion of each of the apertures. The apertures may further be disposed along the top wall on either side and equidistant from a notional centerline extending between the end edges of the top wall, the central portion being further positioned generally along the centerline.

Preferably, each of the end flaps is narrower between the side edges thereof than the top wall between the side edges thereof. Each of the end portions of the handle reinforcing structure may be connected to the central portion along fold lines, and each of the end portions may be connected to the end flaps along fold lines.

A reinforcing strip may be connected along a fold line to the central portion of the handle reinforcing structure, the strip being adhered to the central portion in overlapping relationship to provide an additional ply for the handle reinforcing structure.

Alternatively, the present invention may provide a blank for forming a carton. The blank includes a bottom panel having opposed side edges and a pair of side panels, one of the side panels connected along a bottom edge to each the side edge of the bottom panel. A top panel having opposed first and second side edges and opposed end edges is connected along the first side edge to one of the side panels. One of a pair of end flaps is connected along its top edge to each of the end edges of the top panel, each of the end flaps further having first and second side edges corresponding to the first and second side edges of the top panel.

A handle aperture is defined in the top panel and positioned thereon generally centrally of the top wall. A handle reinforcing structure includes a pair of end portions, one of the end portions connected along a fold line to the second side edge to each of the end flaps. A central portion is connected to each of the end portions and extends therebetween generally along but separated from the second side edge of the top panel. The end portions and the central portion are arranged whereby upon folding of the end portions along the fold lines into overlapping relationship with the end flaps, the central portion is positioned in overlapping relationship to the top panel to be substantially adjacent to a portion of the handle aperture.

The top panel may have a pair of handle portions formed therein, in which case the central portion is arranged to be positioned on the top panel to extend between the apertures, adjacent to a portion of each of the apertures.

Preferably, the second side edge of each of the end flaps is inset on the end flaps with respect to the second side edge on the top wall. Also, each of the end portions of the handle reinforcing structure is preferably connected to the central portion along fold lines substantially aligned with the end edges of the top panel.

The handle reinforcing structure may also be provided with a reinforcing strip connected along a fold line to the central portion of the handle reinforcing structure. The reinforcing strip is preferably positioned on the blank between the central portion of the handle reinforcing structure and the top panel.

The blank may also include a glue flap foldably connected to the second side edge of the top panel. The glue flap and the reinforcing strip are positioned on the blank adjacent each other, and are separated, preferably by a cut line.

BRIEF DESCRIPTION OF THE DRAWINGS

In FIG. 5, a portion of the end closure flap and top wall panel are broken away.

DETAILED DESCRIPTION OF THE PREFERRED EMBODIMENT

Figure 1:
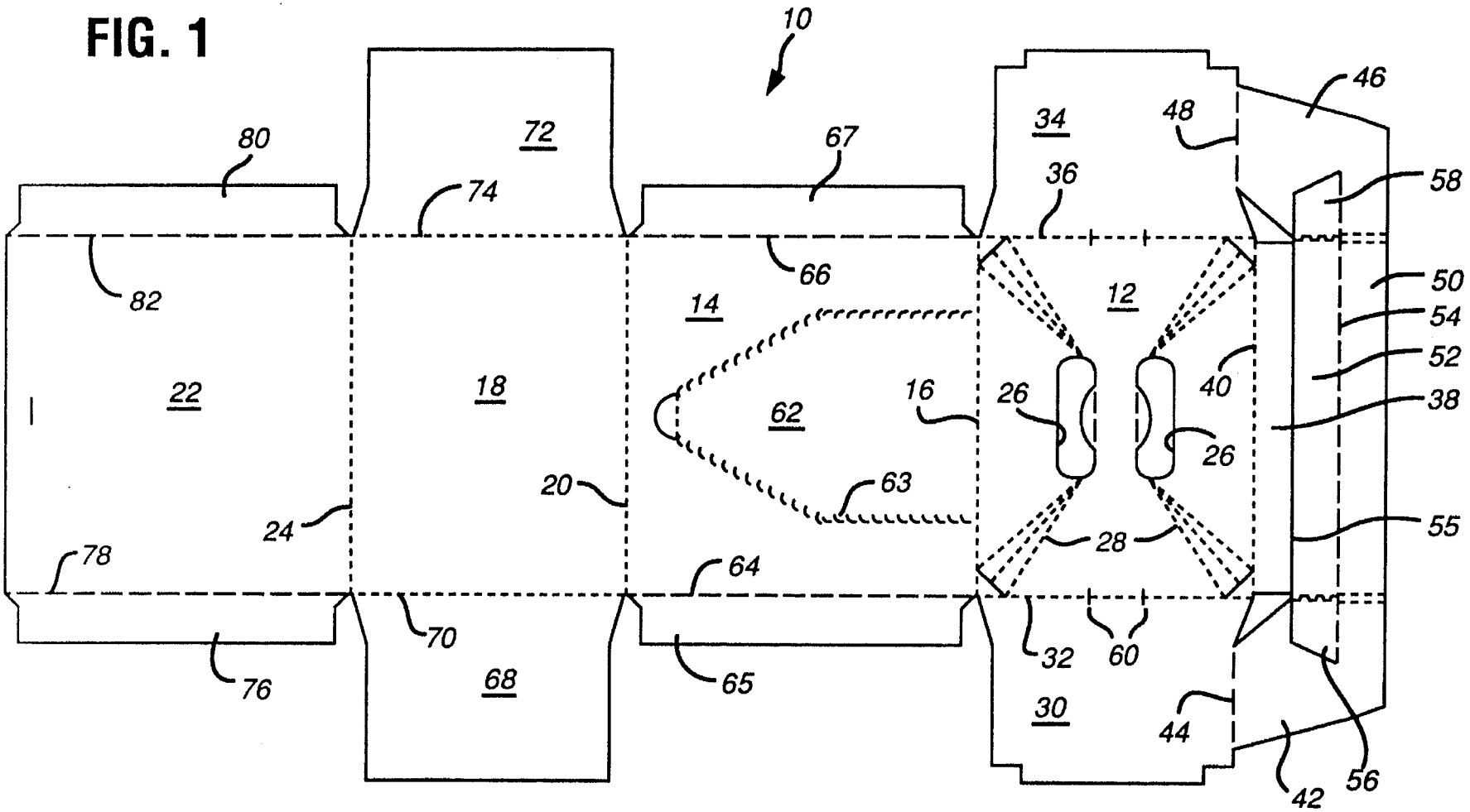
FIG. 1 is a plan view of the inner surface of a blank for forming a carton incorporating a dispenser in accordance with the present invention.

A carton 10 for use in connection with the present invention may be seen in blank form by reference to FIG. 1. The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

Top wall panel 12 includes a pair of hand apertures 26 for forming a portion of a handle structure for the carton. Additionally, reinforcing fold lines 28 extend from apertures 26 toward the corners of top wall panel 12, in accordance with the handle structure disclosed in U.S. patent application Ser. No. 08/065,277. However, other known arrangements of reinforcing fold lines may be used. In some cases, the fold lines may even be eliminated A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

A handle reinforcing structure in accordance with the present invention is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. An auxiliary handle reinforcing strip 52 is connected to central portion 50 along a fold line 54. Reinforcing strip 52 is positioned adjacent to glue flap 38, separated therefrom along a cut line 55.

Auxiliary reinforcing strip 52 includes end flap 56 which extends into end portion 42, and end flap 58 which extends into end portion 46.

End flaps 56 and 58 are connected to the central portion of reinforcing strip 52 along fold lines which are debossed so as to protrude inwardly of the erected carton. Similarly, end reinforcing portions 42 and 46 are connected to central portion 50 along fold lines debossed inwardly. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. patent application Ser. No. 08/089,710, which is incorporated herein by reference.

Side wall panel 14 includes a removable access panel 62 defined by a perforated tear line 63. Connected at one end edge of side wall panel 14 along fold line 64 is a minor end flap 65, and connected by a fold line 66 at an opposite end edge is minor end flap 67.

Bottom wall panel 18 has a major end flap 68 connected along fold line 70 at one end edge thereof, while a second major end flap is connected at an opposite end edge along fold line 74.

Finally, side wall panel 22 includes a minor end flap 76 connected at one end edge along fold line 78, and a minor end flap 80 connected along fold line 82 at the opposite end edge.

Figure 3:
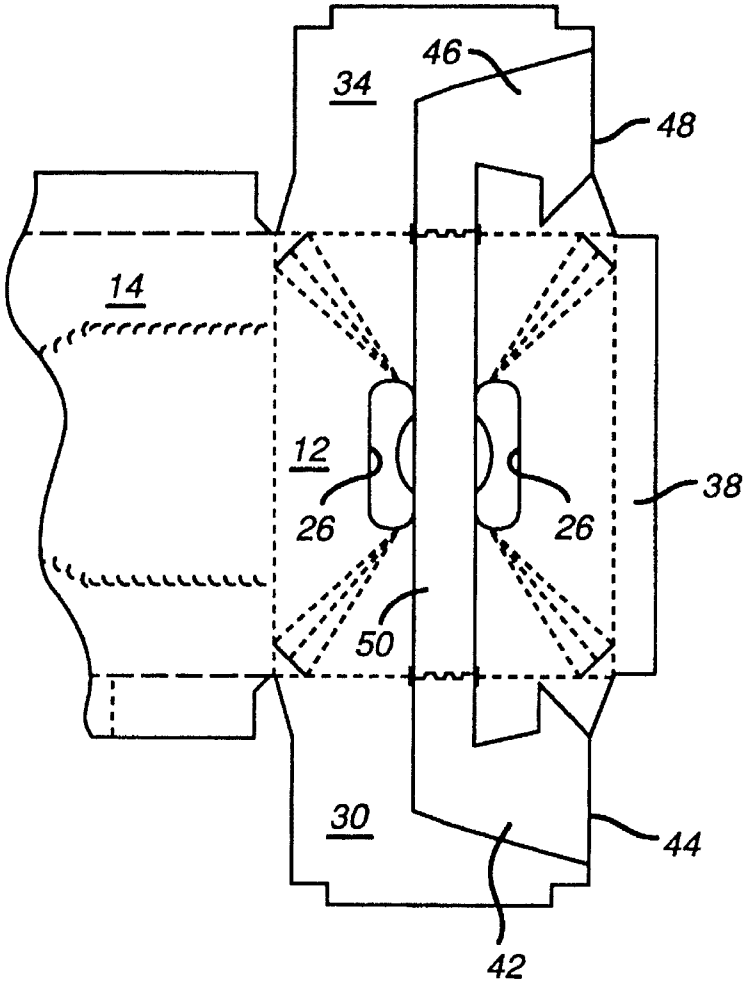
FIG. 3 is a partial plan view similar to FIG. 2, showing a further step in the formation of a carton from the blank of FIG. 1.
Figure 2:
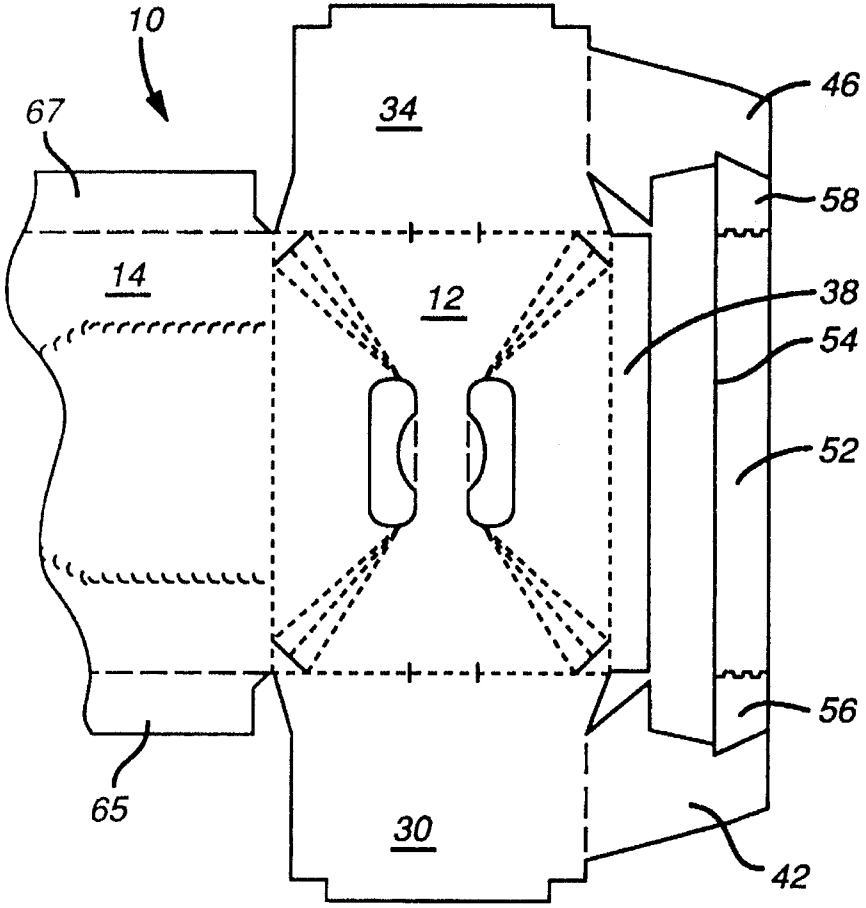
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. Auxiliary reinforcing strip 52 is folded about fold line 54 and glued to the central portion 50 of the handle reinforcing structure, while flaps 56 and 58 are glued to end portions 42 and 46 respectively. Next, as shown in FIG. 3, the handle reinforcing structure is folded about fold lines 44 and 48, and end portions 42 and 46 are glued to major end panels 30 and 34, respectively. Central portion 50, and the auxiliary reinforcing flap 52 adhered thereto, are glued to top wall panel 12, so as to extend along the region between the hand apertures 26. Thus, a triple-ply reinforced structure between the apertures 26 is formed.

By reference back to FIG. 1, it can be seen that the reinforcing structure provided by end portions 42 and 46, central portion 50 and reinforcing strip 52 enables the blank for carton 10 to be efficiently laid out for use of space available on the paperboard web from which the blank is formed. It will be recognized that for reinforcement of the handle region, it is necessary for the reinforcing structure to extend between the handle apertures 26. In a conventional structure, wherein an overlapping top panel is provided at an opposite end of the blank, it is necessary to provide a reinforcing panel of somewhat greater than half the top wall panel.

In the present invention, the reinforcing structure is connected only to the end flaps 30 and 34. In the preferred embodiment, the side edges of these flaps are inset with respect to the fold line 40 defining the edge of top wall panel 12. Thus, the end portions 42 and 46 of the reinforcing structure can be of a width less than half of the top wall panel, while still locating central portion 50 centrally of top wall panel 12 to provide the desired reinforcement. This further reduced overall blank size. As an additional advantage, The reinforcing structure extends beyond the top wall panel 12 and into the end flaps 30 and 34.

Figure 5:
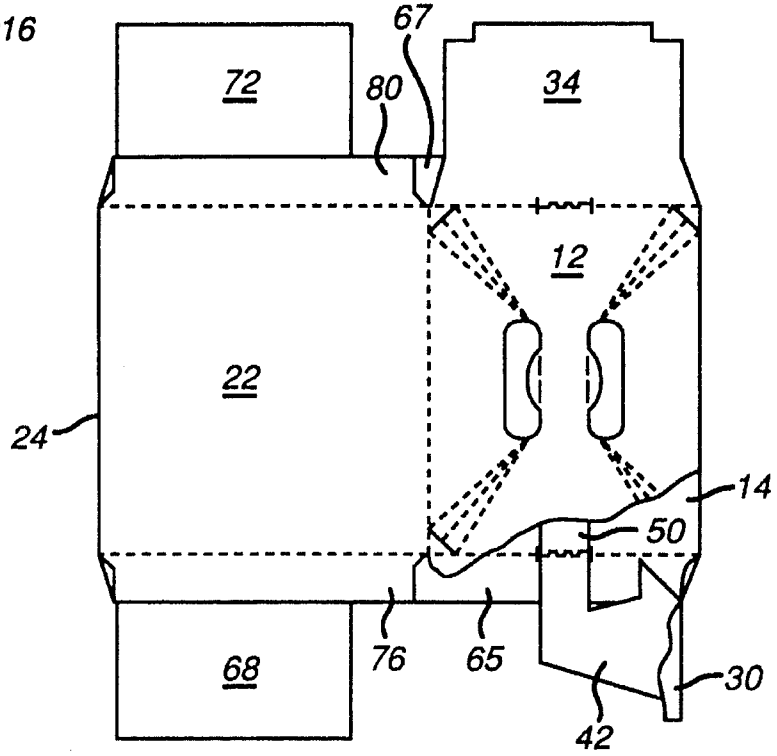
FIGS. 4 and 5 are plan views of the blank of FIGS. 1, 2 and 3, further illustrating the formation of the carton.
Figure 4:
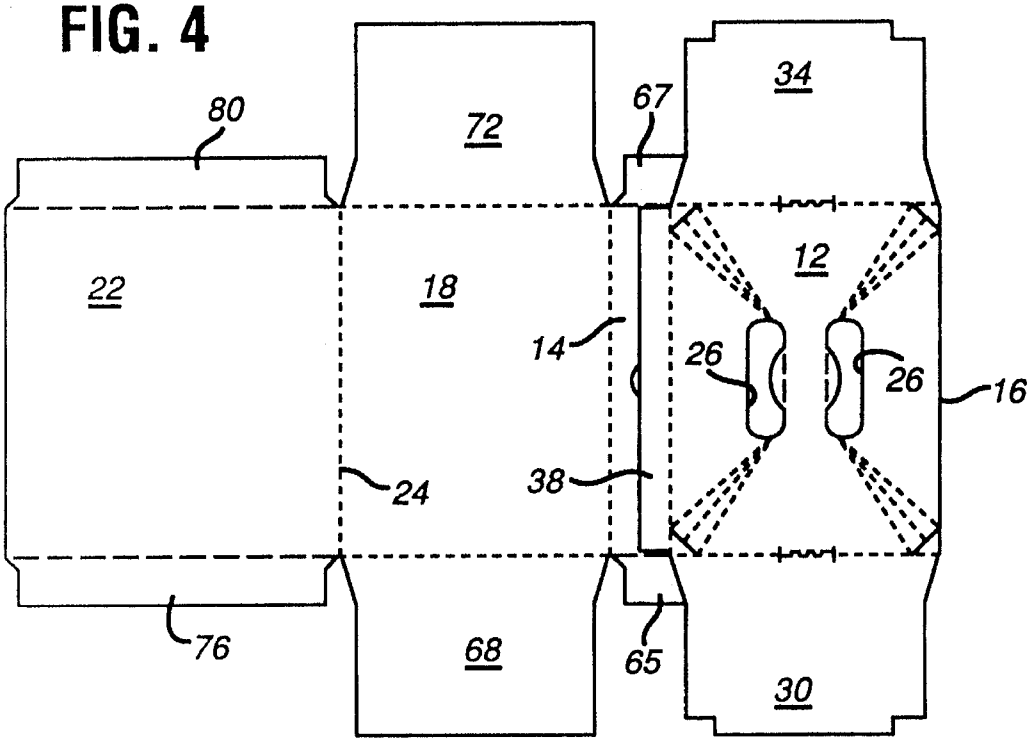

The remainder of the assembly of carton 10 can be seen by reference to FIGS. 4 and 5. In FIG. 4, the top wall panel 12 is shown folded along fold line 16 into overlapping arrangement with side wall panel 14. Glue is applied along glue flap 38 and, as shown in FIG. 5, side wall panel 22 is folded along fold line 24. The upper edge of side wall panel 22 is then adhered to glue flap 38 to complete the collapsed carton. (A portion of end flap 30 and top wall panel 12 is shown broken away in FIG. 5 to reveal the reinforcing structure end portion 42 and central portion 50.)

Figure 6:
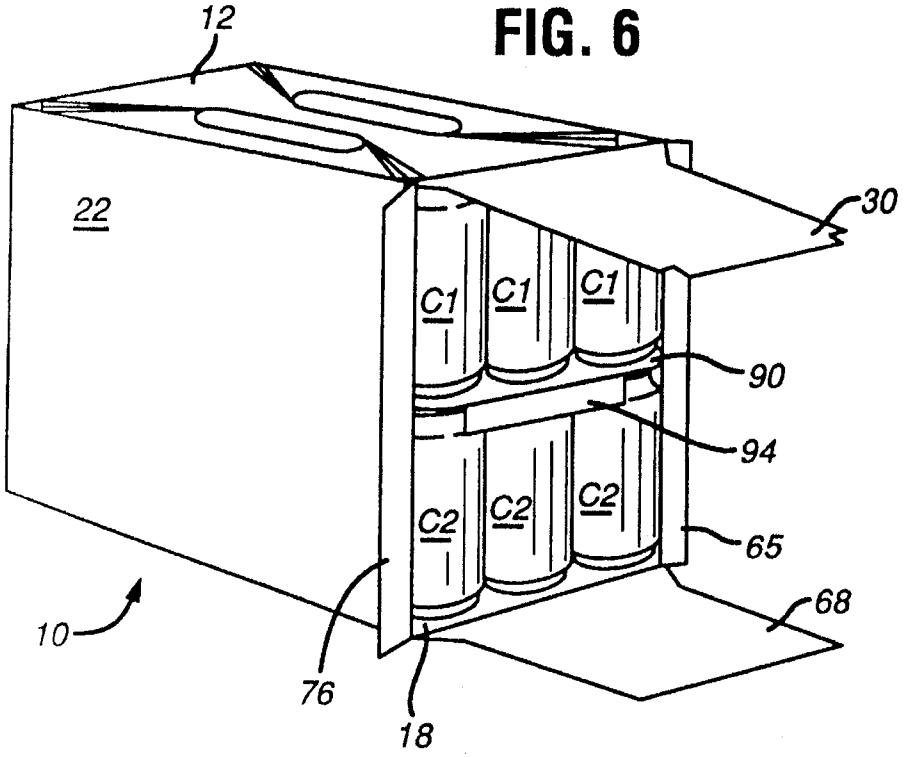
FIG. 6 is a three-quarter view of the top, side and end of an erected and loaded carton formed from the blank of FIG. 1, showing the end closure structure prior to folding and sealing.

The carton is loaded as shown in FIG. 6. First, the carton is erected into a tubular structure. The carton 10 is shown with its end closure structure, comprising major end flaps 30 and 68 and minor end flaps 65 and 76, open prior to the application of glue for sealing. The carton is loaded, as shown here for example, with beverage cans arranged into two tiers. A divider insert 90 is positioned between the tiers. Cans C1 of the upper tier are positioned on insert 90, which in turn rests upon the tops of the cans C2 of the lower tier. Cans C2 are in turn positioned on the bottom wall panel 18 of the carton 10. The can arrangement, as is conventional, is assembled prior to loading, and the stacked and arranged cans are loaded by pushing into the carton tube through one or both of its open ends. Such operation may be carried out by suitable, automated packaging machinery.

Closure and sealing of the end closure structure is effected in the following manner. Minor end flaps 65 and 76 are folded to a closed position against the packaged cans. Glue is applied to minor end flaps 65 and 76 and, preferably, to end flap 94 attached along a fold line to the edge of insert 90. Major end flap 30 is then folded downwardly and secured to the flaps 65, 76 and 94. Additional glue is applied to the outer end of the inner surface of major end flap 68, which is folded upwardly and sealed to major end flap 30.

An identical operation is carried out to close and seal end closure structure located at the opposite end of the carton.

Figure 7:
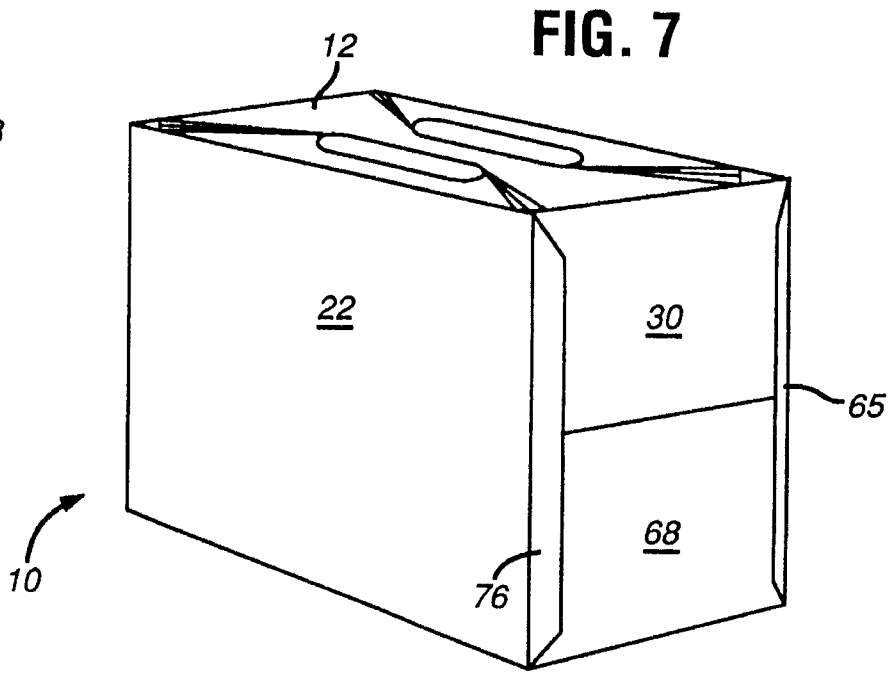
FIG. 7 is a view similar to FIG. 6, but showing the end closure structure sealed to form the finished carton.

The loaded and sealed carton may be seen by reference to FIG. 7.

It should be readily recognized that while in the preferred embodiment, the present invention has been described in connection with a carton for packaging two tiers of cans, the handle reinforcing structure may also be used with a carton for packaging only a single tier of cans, or for a carton for packaging bottles, jars or other primary containers.

It will also be recognized that the reinforcing structure can be used with a variety of handle arrangements other than that specifically described herein. For example, the exact shape of the apertures may be varied, depending upon product orientation, carton size and the like. In appropriate cases, only a single aperture may be used. What is important is that the handle aperture be located approximately near the center of the top wall panel, adjacent to the reinforcing, three-ply structure.

What is claimed is:

1. A blank for forming a carton, comprising: a top wall panel having opposed first and second side edges and opposed first and second end edges; a series of wall panels foldably connected one to the next, including a first panel in said series foldably connected to said top wall panel along said first side edge thereof and a last panel in said series disposed at an opposite end of said series from said first panel;

first and second end flaps each having top edges, said first end flap being connected along said top edge to said first end edge of said top wall panel, and said second end flap being connected along said top edge to said second end edge of said top wall panel, each of said end flaps further having first and second side edges corresponding generally to said first and second side edges of said top panel;

a handle aperture defined in said top wall panel and positioned thereon generally centrally of said top wall; and a handle reinforcing structure including first and second end portions, said first end portion connected along a fold line to said second side edge of said first end flap, and said second end portion connected along a fold line to said second side edge of said second end flap, and a central portion connected to each of said end portions and extending therebetween generally along said second side edge of said top panel;

wherein said central portion defines a pair of free edges extending along the length thereof, whereby said central portion is separated from said top wall panel.

2. A blank as defined in claim 1, further comprising a glue flap foldably connected to said second side edge of said top wall panel and disposed between said glue flap and said central portion.

3. A blank as defined in claim 1, wherein each of said fold lines connecting said first and second end portions to said first and second end flaps is inset on its respective one of said end flaps with respect to said second side edge on said top wall panel.

4. A blank as defined in claim 1, wherein said second side edge of each of said end flaps is inset on said end flaps with respect to said second side edge on said top wall panel.

5. A blank as defined in claim 1, wherein said top wall panel has a pair of handle apertures formed therein.

6. A blank as defined in claim 1, wherein each of said end portions of said handle reinforcing structure is connected to said central portion along fold lines substantially aligned with said end edges of said top wall panel.

7. A blank as defined in claim 1, further comprising a reinforcing strip connected along a fold line to one of said free edges of said central portion of said handle reinforcing structure.

8. A blank as defined in claim 7, wherein said reinforcing strip is positioned between said central portion of said handle reinforcing structure and said top panel.

9. A carton for containers such as bottles or cans, formed from a blank as defined in claim 1.

10. A carton for containers such as bottles or cans, comprising:

a top wall panel having opposed first and second side edges and opposed first and second end edges;

a pair of side walls foldably connected to said top wall panel along said first and second side edges thereof;

a bottom wall foldably connected between said side walls;

first and second end flaps each having top edges, said first and second end flaps being connected respectively along said top edges to said first and second end edges of said top wall and depending downwardly therefrom, each of said end flaps further having first and second side edges corresponding generally to said first and second side edges of said top panel;

a handle aperture defined in said top wall panel and positioned thereon generally centrally of said top wall; and a handle reinforcing structure including first and second end portions, said first and second end portions being connected along a fold line to said second side edge of said first and second end flaps respectively, said first and second end portions being disposed in overlapping relationship along an inner surface of said first and second end flaps respectively, and a central portion connected between said end portions and extending in overlapping relationship along an inner surface of said top wall panel substantially adjacent to a portion of said handle aperture;

wherein said central portion defines a pair of free edges extending along the length thereof which are separated from said side edges of said top wall panel.

11. A carton as defined in claim 10, wherein each of said fold lines connecting said first and second end portions to said first and second end flaps is inset on its respective one of said end flaps with respect to said second side edge on said top wall panel.

12. A carton as defined in claim 10, wherein said second side edge of each of said end flaps is inset on said end flaps with respect to said second side edge on said top wall panel.

13. A carton as defined in claim 10, wherein said top wall panel has a pair of handle apertures formed therein, and wherein said end portions and said central portion are arranged whereby said central portion extends along said top wall panel between said apertures, adjacent to a portion of each of said apertures.

14. A carton as defined in claim 10, wherein each of said end portions of said handle reinforcing structure is connected to said central portion along fold lines substantially aligned with said end edges of said top wall panel.

15. A carton as defined in claim 10, further comprising a reinforcing strip connected along a fold line to said central portion of said handle reinforcing structure and folded into overlapping relationship therewith.

* * * * *